US005339567A

United States Patent [19]

Pierpont et al.

[11] Patent Number: 5,339,567

[45] Date of Patent: Aug. 23, 1994

[54] INTERIOR-MOUNTED SECURITY BARS

[76] Inventors: John M. Pierpont; Pauline S. Pierpont, both of 3800 Birch St. NE., St. Petersburg, Fla. 33703

[21] Appl. No.: 80,895

[22] Filed: Jun. 22, 1993

[51] Int. Cl.[5] ..... E06B 3/68

[52] U.S. Cl. ..... 49/55; 49/57

[58] Field of Search ..... 49/55, 57, 56, 50

[56] References Cited

U.S. PATENT DOCUMENTS

| | | | |
|---|---|---|---|
| 785,690 | 3/1905 | Wolfe | 49/56 X |
| 2,589,878 | 3/1952 | Shapiro | 49/57 X |
| 4,243,090 | 1/1981 | Kemp | 49/56 X |
| 4,671,012 | 6/1987 | Merklinger et al. | 49/55 |
| 4,899,490 | 2/1990 | Jokel | 49/55 |
| 5,018,302 | 5/1991 | Kluge | 49/55 X |
| 5,070,647 | 12/1991 | Spialter | 49/55 |

*Primary Examiner*—Philip C. Kannan

*Attorney, Agent, or Firm*—Joseph C. Mason, Jr.; Ronald E. Smith

[57] ABSTRACT

An assembly that includes security bars is mounted in the interior of a structure in registration with a window so that entrance into the structure is denied even when the window is open. Frame members are permanently secured to the structure adjacent the window to be protected, on opposite sides of the window. Complementally formed end piece members are slideably received within their associated frame members and are free to slide upwardly and downwardly with respect to the frame members. A first set of bars extends horizontally from the first end piece towards the second end piece and a second set of bars extends horizontally from the second end piece towards the first end piece. The respective free ends of the first and second sets of bars telescopically engage one another so that the assembly may be fitted to windows of differing widths. The contour of the end piece members matches the contour of their associated frame members so that the end pieces cannot be displaced horizontally and therefore cannot escape the frame members when a horizontally-directed force is applied to them.

6 Claims, 2 Drawing Sheets

INTERIOR-MOUNTED SECURITY BARS

BACKGROUND OF THE INVENTION

1. Field of the invention

This invention relates to security bars of the type mountable over a window to keep out intruders. More particularly, it relates to security bars that are easily removable by a person inside the protected structure.

2. Description of the prior art

Early security bars were mounted to the exterior of occupied structures, in registration with windows, to prevent unauthorized access into the protected structure. Although such devices performed their intended function, they also prevented escape through such windows when fire or other emergency conditions mandated such escape.

Accordingly, inventors turned their attention to security bars that could be mounted on the interior side of the windows so that such bars could be removed to allow egress from the structure if required. Examples of interior-mounted security bars may be seen in U.S. Pat. Nos. 5,018,302 to Kluge, 4,243,090 to Kemp, Re 17,978 to McWane, and 785,690 to Wolfe. Although such constructions represent considerable improvements over the exterior mounted, somewhat dangerous security bars of the past, they lack a number of important features.

For example, the art fails to teach security bar assemblies having width adjustment means so that such assemblies could be used with windows of varying widths. Consequently, the art fails to suggest how interior mounted security bars could be provided with width adjustment means.

Moreover, the art fails to teach interior-mounted security bar assemblies that are very quickly and easily removable. Some earlier devices appear at first glance to be quickly and easily removable, but are found to be otherwise upon close inspection. More particularly, some designs are mechanically complex and thus tend to jam when an effort is made to remove them quickly. Once jammed, they are difficult to un-jam.

What is needed, then, is an interior-mounted security bar assembly that fits windows of differing widths and which has an elegant design so that it can be removed quickly and easily without jamming. However, when the art of interior and exterior-mounted security bar assemblies was considered as a whole at the time the present invention was made, it was not obvious to those of ordinary skill how the needed assembly could be created.

SUMMARY OF THE INVENTION

The longstanding but heretofore unfulfilled need for an improved security bar assembly is now fulfilled in the form of an assembly that includes a set of equidistantly-spaced bars that is slideably mounted for facile removal from a fixed position frame when lifted upwardly. The novel assembly is also width-adjustable, but includes novel design features that prevent an intruder from gaining entry by reducing the width of the assembly. As a result, an individual desiring to leave a window open at night during sleep or during the day may do so without fear of an intruder defeating the security bar assembly.

The assembly includes a pair of vertically oriented frame members that are fixedly secured to a wall on opposite sides of a window to be protected. Each frame member has a predetermined shape and slidingly receives a complementally-formed end piece, and a plurality of telescoping, horizontally oriented bars interconnect said end pieces. Each bar has a first or outermost end that is formed integrally with or attached by suitable means to its associated end piece, and a free end adapted to telescopingly engage the free end of its associated bar. Significantly, the end pieces and the frame members within which they are slideably received have a common transverse cross section so that the end pieces may not be displaced in a lateral, i.e., horizontal direction with respect to their associated frame members; this prevents telescoping movement of the bars once their associated end pieces are slidingly received within the frame members and thus defeats attempts to collapse the structure by moving the end pieces toward one another.

The invention also includes means for locking the assembly against slideable removal of the end pieces from the frame members.

It should therefore be understood that the primary object of this invention is to provide security bars that are quickly and easily removable from a window in the event egress from said window is desired on an emergency basis.

Another important object is to provide a security bar assembly that fits windows of varying widths.

Still another important object is to provide a security bar assembly having telescoping parts which cannot be collapsed when the assembly is installed.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
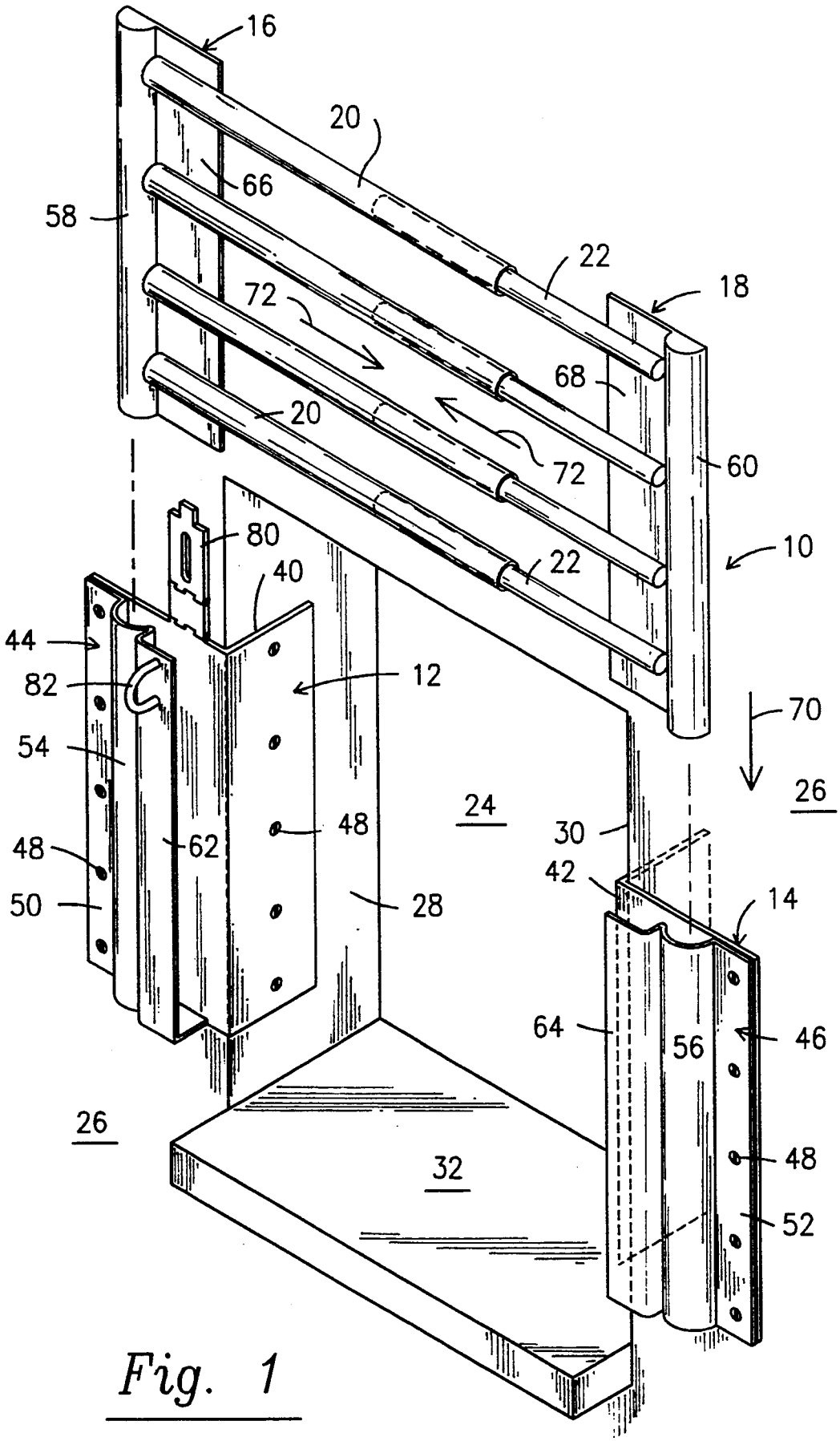
FIG. 1 is a perspective view showing the security bars after they have been removed from their frame to allow escape from the dwelling through a window and indicating how they are inserted into their window-barring configuration.

Referring now to FIG. 1, it will there be seen that an illustrative embodiment of the invention is denoted as a whole by the reference numeral 10. Assembly 10 includes a first frame assembly 12, a second frame assembly 14, a first end piece 16, a second end piece 18, a first plurality of bars, collectively denoted 20, and a second plurality of bars, collectively denoted 22. The respective bars of the first and second plurality of bars are shown disposed in telescoping relation to one another;

thus, the spacing between end pieces 16 and 18 is easily adjusted to correspond to the spacing between frame assemblies 12 and 14, said spacing being dependent upon the width of the window protected by assembly 10.

Window 24 is formed in wall 26 of a structure, and includes opposed surfaces 28 and 30 which are disposed normal to wall 26, and sill 32.

Each frame assembly includes an "L"-shaped base plate 40, 42 and an end piece-capturing member 44, 46 of predetermined configuration. A plurality of screws, collectively denoted 48, fixedly secure base plates 42, 44 to opposed surfaces 28, 30 of the window, respectively, and further secure end piece-capturing members 44, 46 to said base plates and to wall surface 26. Special screws of the type that require a special screwdriver to remove may be employed.

End piece-capturing members 44, 46 include flat flanges 50, 52, respectively, for receiving said screws 48, curved parts 54, 56, for slideably receiving complementally-shaped parts 58, 60 of end pieces 16, 18, respectively, and "L"-shaped parts 62, 64 that slideably receive the outermost ends of bars 20, 22, respectively, and flat parts 66, 68 of end pieces 16, 18, respectively, to which said outermost ends of said bars are fixedly secured.

Directional arrow 70 indicates how the novel structure is assembled; the curved, elongated hemispherical parts 58, 60 of end pieces 16, 18 are slideably introduced into complementally-shaped parts 54, 56 of frame members 12, 14. This results in introduction of the outermost ends of bars 20, 22 and the flat plates 66, 68 to which they are welded into the area that is partially enclosed by "L"-shaped members 62, 64 of frames 12, 14. Inwardly directed displacement of bars 20, 22, indicated by converging directional arrows 72, 72, is prevented by the configuration of curved parts 54, 56 of said frame members 12, 14, because said parts capture the complementally-formed parts 58, 60 of end pieces 16, 18. This prevents an intruder from defeating the security bars by the expedient of collapsing telescoping bars 20, 22 toward one another as indicated by said arrows 72, 72.

To prevent an intruder from lifting the bars and end piece assembly from the frame assembly, many different locking means may be employed. A suitable locking means includes a hingedly-mounted latch 80 and a catch 82, shown at the left side of FIG. 1. A padlock 84, shown in FIG. 2, may then be used to secure the bar assembly against removal by an intruder. For safety purposes, a key to padlock 84 would be mounted on wall 26 near padlock 84 but out of the reach of an individual positioned outside the structure.

Figure 2:
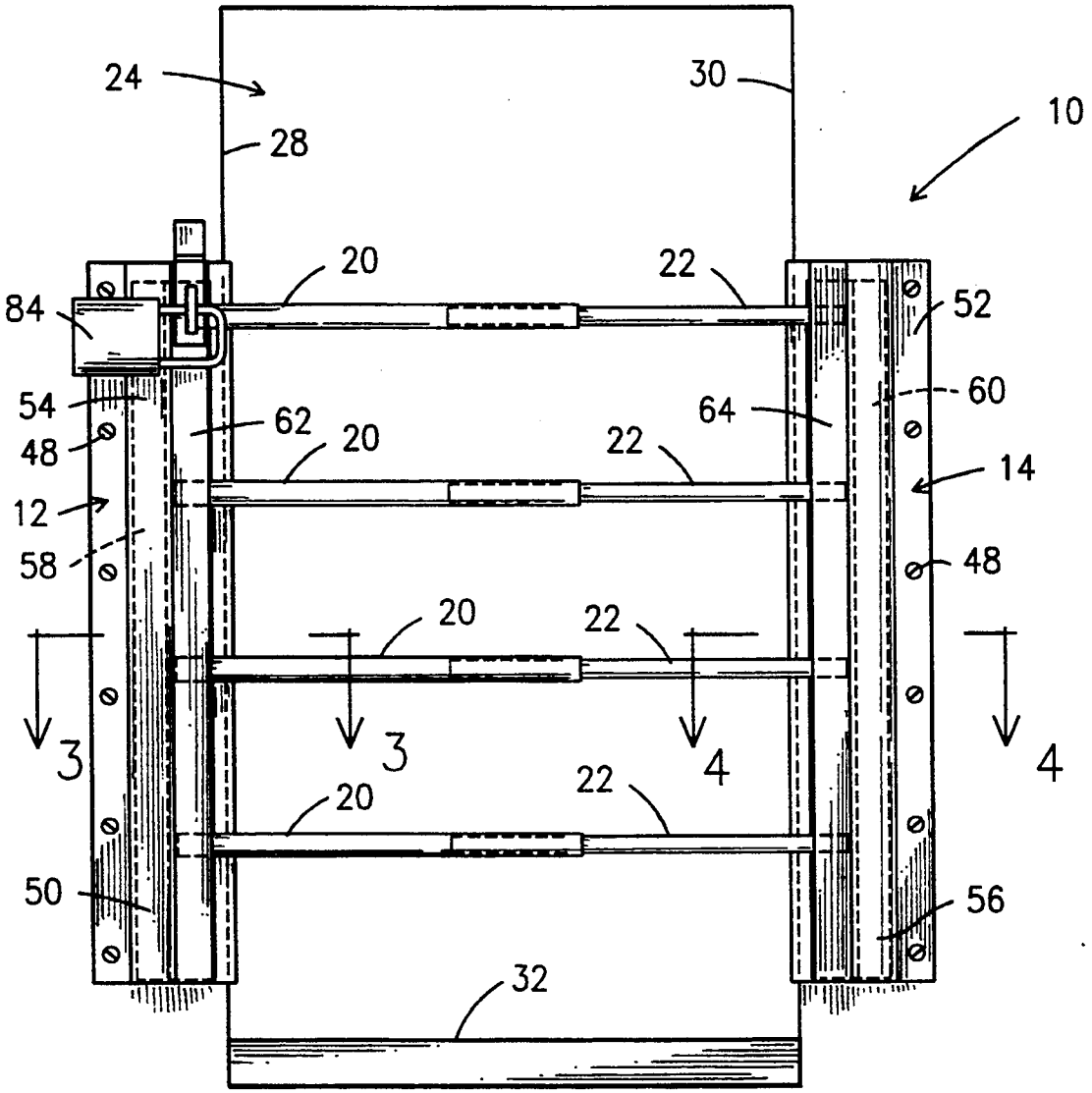
FIG. 2 is a front elevational view with the security bars locked into their window-barring configuration.

As shown in FIGS. 1 and 2, the lowermost bar is placed about six inches above window sill 32; this arrangement prevents an intruder from crawling under the lowermost bar while leaving enough space at the top of the window to enable removal of the bars in an emergency while still preventing an intruder from easily crawling over the uppermost bar.

Figure 3:
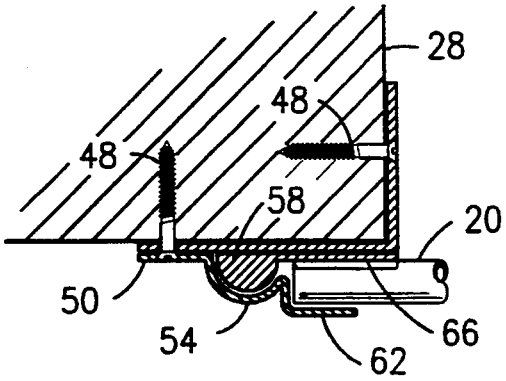
FIG. 3 is a sectional view taken along line 3—3 in FIG. 2.
Figure 4:
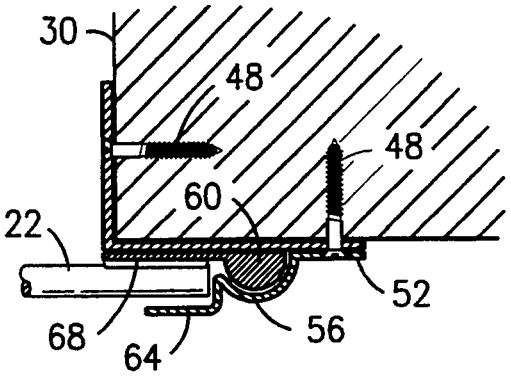
FIG. 4 is a sectional view taken along line 4—4 in FIG. 2.

From FIGS. 3 and 4 it should be appreciated that hemispherical parts 54, 56 and their mating parts 58, 60 need not have the particular configuration depicted; any mating predetermined geometrical configuration that captures parts 58, 60 and holds them against laterally inward travel while permitting them to slide up and down is within the scope of this invention.

It should also be understood that the novel assembly could be arranged relative to window 34 so that the bars 20, 22 are vertically disposed. Differing bar lengths can of course be made to accommodate windows of differing sizes, but the telescoping arrangement of bars disclosed herein will accommodate almost all windows.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A security bar assembly, comprising: a first and a second frame member, each of said frame members having an elongate, predetermined configuration;

mounting means for substantially permanently attaching each of said frame members to a mounting surface;

a first and a second end piece adapted for slidingly engagement with said first and second frame members, respectively;

a first plurality of bars, each bar of said first plurality of bars having a first end fixedly secured to said first end piece and having a second free end;

a second plurality of bars, each bar of said second plurality of bars having a first end fixedly secured to said first end of said second end piece and having a second free end;

each free end of said first plurality of bars being adapted to telescopically engage a free end of an associated bar of said second plurality of bars; and said first frame member and said first end piece having a common transverse cross section, said first end piece being captured by said first frame member and being slideable along the extent of said first frame member but being held against lateral displacement relative to said first frame member; and said second frame member and said second end piece having a common transverse cross section, said second end piece being captured by said second frame member and being slideable along the extent of said second frame member but being held against lateral displacement relative to said second frame member.

2. The assembly of claim 1, further comprising locking means for preventing slideable movement of said first and second end pieces along the respective extents of said first and second frame members.

3. The assembly of claim 2, wherein said plurality of first and second bars collectively form a plurality of barrier members when their respective free ends are telescopically engaged to one another, and wherein said barrier members are equidistantly spaced with respect to one another.

4. The assembly of claim 3, wherein said assembly is mounted on an interior side of a structure and wherein said first and second frame members are mounted to said structure on opposite sides of a window.

5. The assembly of claim 4, wherein said first and second frame members each include an "L"-shaped base member which is fixedly secured to said mounting surface.

6. The assembly of claim 5, wherein said first and second frame members each include an end piece-capturing member having a flat flange, a curved, elongated hemispherical part, and an "L"-shaped part formed integrally with one another, said flat flange disposed in overlying relation to and being fixedly secured to an outermost end of its associated base member.

* * * * *